US006564606B2

(12) United States Patent
Okada et al.

(10) Patent No.: US 6,564,606 B2
(45) Date of Patent: May 20, 2003

(54) MANUFACTURING METHOD AND MANUFACTURING APPARATUS FOR METALLIC BELLOWS

(75) Inventors: Hideki Okada, Yokohama (JP); Tsutomu Furuyama, Yokohama (JP)

(73) Assignee: NHK Spring Co., Ltd., Yokohama (JP)

( * ) Notice: Subject to any disclaimer, the term of this patent is extended or adjusted under 35 U.S.C. 154(b) by 0 days.

(21) Appl. No.: 09/878,085

(22) Filed: Jun. 8, 2001

(65) Prior Publication Data

US 2001/0052253 A1 Dec. 20, 2001

(30) Foreign Application Priority Data

Jun. 16, 2000 (JP) ..... 2000-181727
Jun. 27, 2000 (JP) ..... 2000-192802

(51) Int. Cl.[7] ..... B21D 51/12
(52) U.S. Cl. ..... 72/59; 29/454
(58) Field of Search ..... 72/59, 370.19; 29/454

(56) References Cited

U.S. PATENT DOCUMENTS 2,773,538 A 12/1956 De Mers
3,015,354 A 1/1962 Wood
3,040,426 A * 6/1962 Hamren ..... 29/454
3,105,539 A 10/1963 Johnson
3,130,771 A 4/1964 Peyton
3,247,694 A 4/1966 Homfeldt et al.
3,326,091 A * 6/1967 Allen ..... 29/454
3,699,624 A 10/1972 De Gain
3,782,156 A 1/1974 Panfill
4,364,252 A * 12/1982 Koizumi ..... 72/59
6,202,281 B1 * 3/2001 Semenov et al. ..... 29/454
6,282,939 B1 * 9/2001 Minamidate et al. .... 72/370.19

FOREIGN PATENT DOCUMENTS

EP 0 395 042 A2 10/1990
EP 0 395 042 * 10/1990 ..... 72/59
EP 1 053 800 A1 11/2000

OTHER PUBLICATIONS

Patent Abstracts of Japan, Publication No. 57146426, published Sep. 9, 1982.
Patent Abstracts of Japan, Publication No. 11–226658, published Aug. 24, 1999.

* cited by examiner

*Primary Examiner*—Lowell A. Larson
(74) *Attorney, Agent, or Firm*—Scully, Scott, Murphy & Presser

(57) ABSTRACT

A manufacturing method for manufacturing a bellows having pleat walls with S-shaped profiles comprises a primary forming process for forming a formed bellows, a pressing process for compressing the formed bellows in the axial direction, and a stretching process for pulling the compressed bellows in the axial direction, thereby obtaining desired pitches and free length. After the stretching process is carried out, the bellows is subjected to an annealing and ageing heat-treatment process. An apparatus for manufacturing the bellows comprises a pair of molds that have their respective forming surfaces in shapes corresponding individually to the pleat walls. The die is slightly retreated away from the pleat walls just before the dies open in the diametrical direction after the pleat walls are formed.

4 Claims, 15 Drawing Sheets

MANUFACTURING METHOD AND MANUFACTURING APPARATUS FOR METALLIC BELLOWS

CROSS-REFERENCE TO RELATED APPLICATIONS

This application is based upon and claims the benefit of priority from the prior Japanese Patent Applications No. 2000-181727, filed Jun. 16, 2000; and No. 2000-192802, filed Jun. 27, 2000, the entire contents of both of which are incorporated herein by reference.

BACKGROUND OF THE INVENTION

The present invention relates to a manufacturing method and a manufacturing apparatus for a metallic bellows incorporated in an accumulator, vacuum valve, or pump.

A metallic bellows has top portions and bottom portions that are formed alternately in its axial direction. The top and bottom portions constitute pleat walls. Conventionally, the top and bottom portions have V-, Ω-, or S-shaped profiles, besides U-shaped profiles. When a bellows that has pleat walls with S-shaped profiles is compressed in its axial direction, its length (compact-state length) is shorter enough than that of an ordinary bellows with U-shaped pleat walls. Thus, the S-profiled bellows can enjoy a long stroke for extension and contraction from its free length. The "free length" described herein is the axial length of the bellows that is not subjected to any external force. The "compact-state length" is the axial length of bellows obtained when the bellows is compressed so that pleat walls come into contact with one another.

In a known method for manufacturing an S-profiled metallic bellows, a plurality of disc-shaped bellows elements with S-shaped profiles that are formed by pressing, for example, are welded in succession to one another. In an alternative method, top portions and bottom portions are formed integrally with one another by bulging a metallic blank tube as a material of a bellows. The former is called a welded bellows, and the latter a formed bellows. The formed bellows has an advantage over the welded bellows in enjoying higher yield of material, small number of manufacturing steps and steadier quality.

As an example of bulging, hydraulic forming may be used integrally to form an S-profiled bellows. In the bellows formed by the hydraulic forming, the radius of curvature of the distal end of each bottom portion, in particular, is considerably greater than that of the distal end of each top portion. Accordingly, the hydraulic forming only cannot make the most of the advantage (shorter compact-state length) of the S-profiled bellows.

A bellows manufacturing apparatus for hydraulic forming comprises first and second dies that are arranged around a blank tube as a material of a bellows. Hydraulic pressure is applied from inside the tube to expand a part of the tube between the first and second dies. At the same time, these dies are moved toward each other so that the expanded part of the tube is held between them, whereupon pleat walls are formed.

The bellows manufacturing apparatus of this type has a problem that if the taper angles of the respective opposite forming surfaces of the paired dies are narrow, the pleat walls are scratched as the dies are opened in the diametrical direction of the tube after the walls are formed. The pleat walls can be prevented from being scratched by widening the taper angles of the forming surfaces of the dies. If the taper angles of the forming surfaces are wide, however, the distance between the respective distal end portions of the dies is so long that the pleat walls cannot be easily formed into desired corrugated configurations (S-shaped configurations).

BRIEF SUMMARY OF THE INVENTION

Accordingly, a first object of the present invention is to provide a manufacturing method for a metallic bellows, whereby the compact-state length of a metallic bellows having pleat walls with S-shaped profiles can be made short enough and the elastic stroke of the bellows can be adjusted to a desired value.

A second object of the invention is to provide a bellows manufacturing apparatus capable of forming pleat walls in accurate shapes without scratching a bellows with S-shaped profiles.

A manufacturing method for a metallic bellows of the present invention that achieves the first object comprises: a primary forming process for forming top portions and bottom portions, having pleat walls with S-shaped profiles, on a metallic blank tube as a material of the bellows so as to be arranged alternately in the axial direction of the tube, thereby obtaining a formed bellows; a pressing process for compressing the formed bellows in the axial direction; and a stretching process for pulling the bellows in the axial direction, thereby obtaining desired pitches and free length, after the pressing process.

According to the bellows manufacturing method of the invention, the compact-state length of the bellows having the S-profiled pleat walls can be made short enough, and a metallic bellows having a desired elastic stroke can be manufactured.

In this bellows manufacturing method, the stretching process may be followed by an annealing and ageing heat-treatment process (removal of distortion), which is carried out at a temperature of, for example, 400° C. to 600° C., in order to increase a spring limit value. According to this invention, the annealing and ageing heat-treatment process improves the elastic limit of the bellows as a spring that extends and contracts repeatedly, and therefore, the durability of the bellows.

In the manufacturing method of the invention, moreover, the heat-treatment process may be followed by a setting process to improve permanent set of the bellows and obtain desired pitches and free length. According to this invention, the pitches and length of the bellows can be adjusted, and the permanent set of the bellows can be improved.

In the manufacturing method of the invention, furthermore, the pressing process may include applying an axial load to the formed bellows and applying hydraulic pressure to the bellows from inside, thereby reducing the radius of curvature of a distal end of each bottom portion of the bellows. According to this invention, the compact-state length of the bellows can be reduced.

A bellows manufacturing apparatus of the invention that achieves the second object comprises: a first die provided around a blank tube; a second die located at a distance from the first die in the axial direction of the tube and dividable in the diametrical direction of the tube; first seal means provided on the inner surface of the tube so as to be located corresponding to the first die; second seal means provided on the inner surface of the tube so as to be located corresponding to the second die and defining a hydraulic chamber in conjunction with the first seal means; hydraulic supply means for supplying a compressed liquid to the hydraulic chamber, thereby causing a part of the tube to expand outward; a die drive mechanism for moving the second die toward the first die, thereby plastically deforming the expanded region of the tube to form pleat walls between the first die and the second die; fine-retreat means for slightly retreating the second die away from the pleat walls before the second die is opened in the diametrical direction of the tube after the pleat walls are formed; a die opening/closing mechanism for opening the second die in the diametrical direction after the second die is retreated by means of the fine-retreat means; and a tube feed mechanism for relatively moving the tube for a given distance in the axial direction of the tube with respect to the second die and the first die after the second die is opened in the diametrical direction.

In the bellows manufacturing apparatus of the invention, a part of the blank tube expands outward as the pressurized liquid is supplied to the hydraulic chamber between the first and second seal means. At the same time, the second die moves toward the first die. Thus, the expanded part of the tube is elastically deformed between the first and second dies, whereupon the pleat walls are formed. After the pleat walls are formed, the fine-retreat means slightly retreats the second die away from the pleat walls. Thereafter, the second die opens in the diametrical direction. After the second die is opened in the diametrical direction, the tube feed mechanism causes the tube to move for the given distance in the axial direction with respect to the second die and the first die. At the same time, the second die is retreated to its initial position.

According to the bellows manufacturing apparatus of the invention, the bellows can be formed having desired pleat walls with S-, V-, Ω-, or U-shaped profiles, depending on the shapes of forming surfaces of the dies. In the case where the pleat walls of bellows are formed by means of irregular forming surfaces with, for example, S-shaped profiles, in particular, they can be prevented from being scratched by the forming surfaces as the dies open in the diametrical direction even if the respective taper angles of the forming surfaces are narrow.

In the bellows manufacturing apparatus of the invention, the respective opposite surfaces of the first die and the second die are provided individually with forming surfaces for forming the pleat walls with S-shaped profiles, for example.

In the bellows manufacturing apparatus of the invention, the respective taper angles of the forming surfaces, with respect to segments perpendicular to the axis of the tube, should be narrow angles of 10° or less. According to this invention, the distance between the respective distal end portions of first die and the second die during forming operation can be made shorter. Thus, the shape of the pleat walls with the S-shaped profiles is stabilized, so that a high-durability metallic bellows can be manufactured.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A first embodiment of the present invention will now be described with reference to FIGS. 1 to 15.

Figure 1:
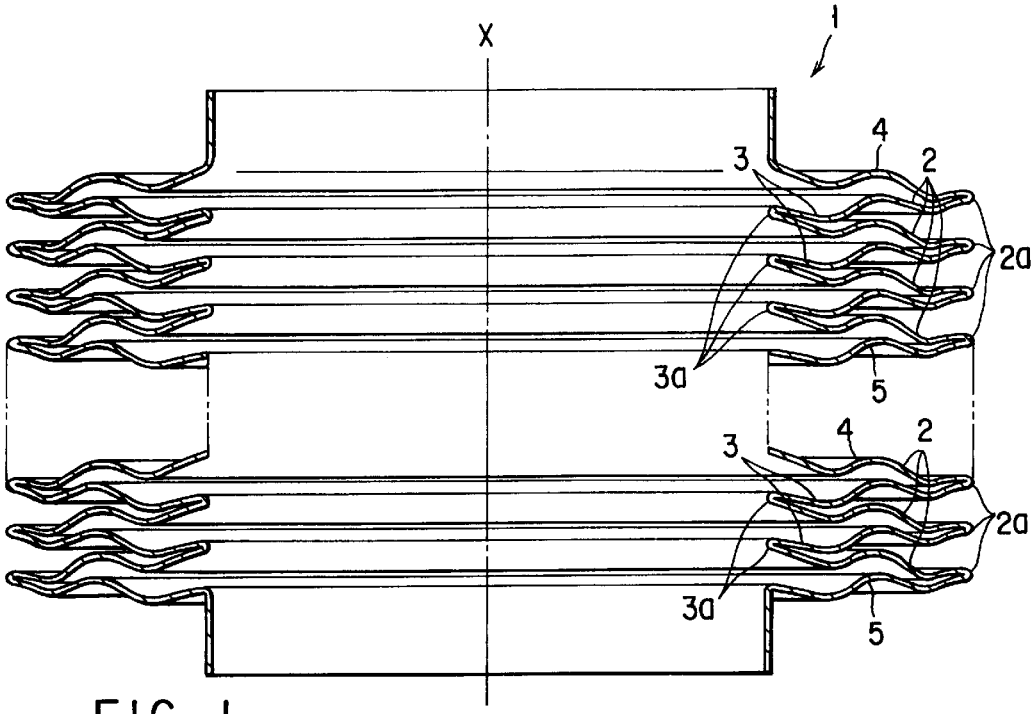
FIG. 1 is a sectional view showing a part of a metallic bellows manufactured by a method according to an embodiment of the present invention.

A metallic bellows 1 shown in FIG. 1 has a plurality of top portions 2 and bottom portions 3 that are arranged alternately in the direction of its axis X. Pleat walls 4 and 5 that form the top portions 2 and bottom portions 3 have an S-shaped profile each. The "S-shaped" used herein describes a configuration such that indentations (curved surfaces) that are smoothly continuous in the diametrical direction of the bellows 1 are formed alternately like waves, and not exactly qualify the shape of an S. Possibly, therefore, each pleat wall may be formed having any other S-shaped profile than the one shown in FIG. 1.

Figure 2:
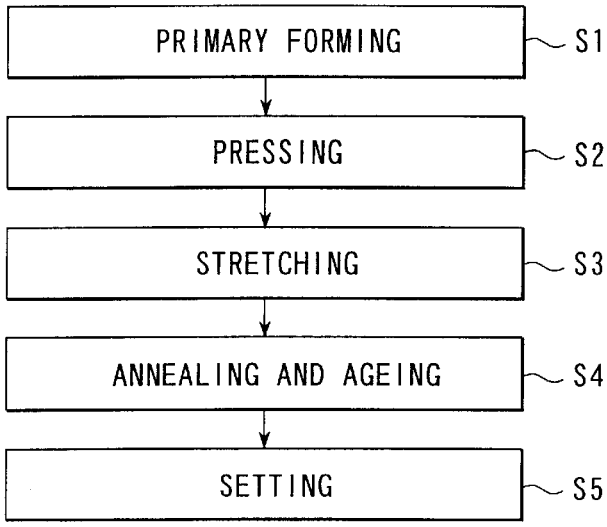
FIG. 2 is a flowchart showing bellows manufacturing processes according to the embodiment.
Figure 3:
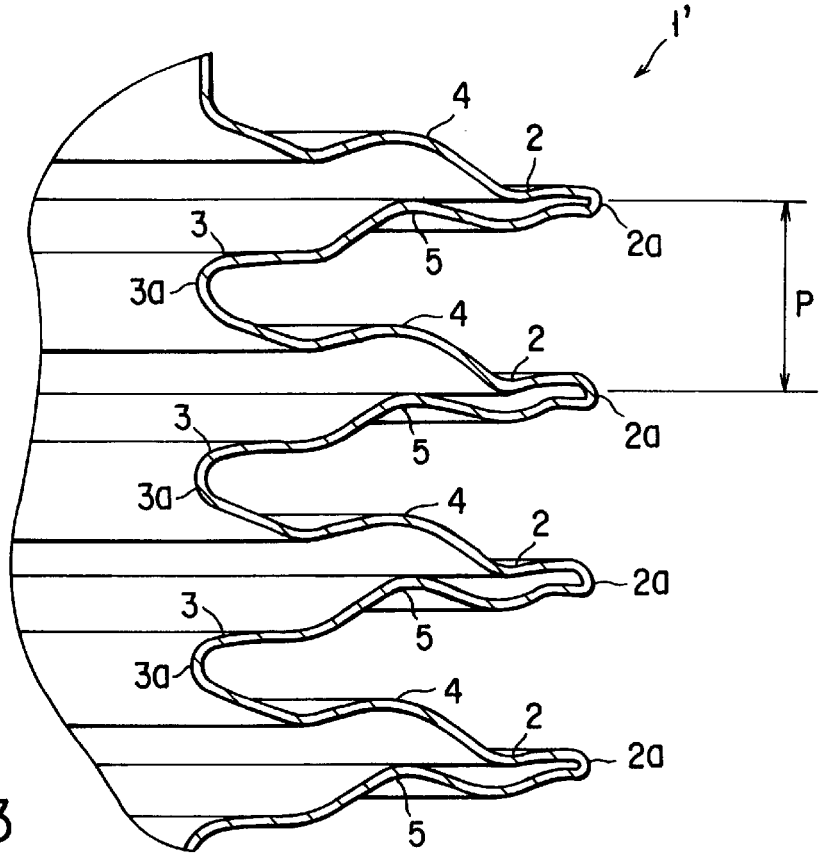
FIG. 3 is a sectional view showing a part of a formed bellows.

FIG. 2 shows manufacturing processes for manufacturing the metallic bellows 1. First, in a primary forming process S1, bulging is carried out. FIG. 3 shows a formed bellows 1' that is manufactured in the primary forming process S1. After the primary forming process S1 is carried out, a pressing process S2 and a stretching process S3 are carried out in succession. If necessary, an annealing and ageing heat-treatment process S4 and a setting process S5 are executed. Although the heat-treatment process S4 and the setting process S5 are not essential, they are expected to be carried out in order to improve the durability and permanent set of the metallic bellows 1, which will be mentioned later.

Figure 5:
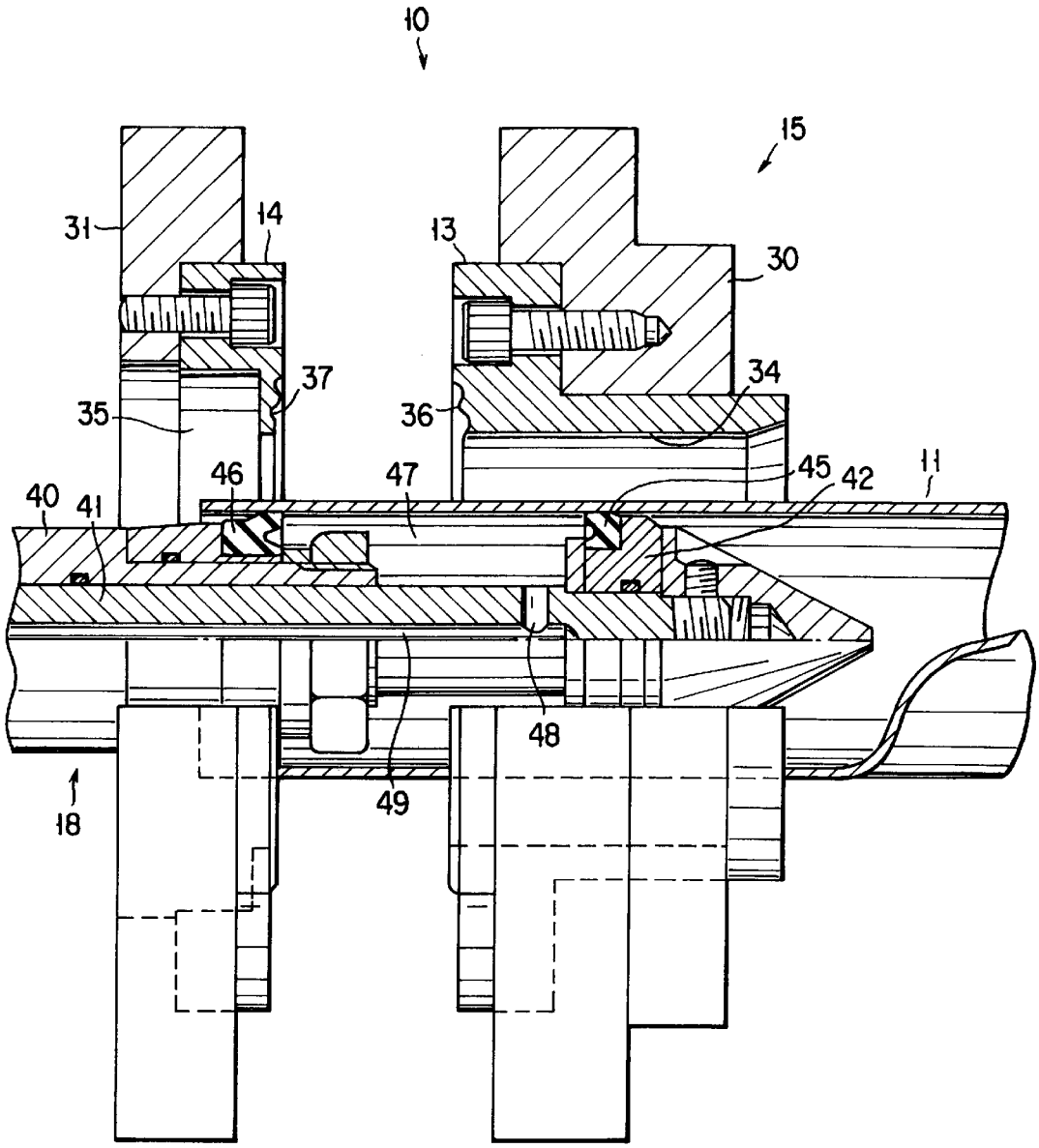
FIG. 5 is a sectional view showing a part of a bellows manufacturing apparatus according to a first embodiment of the invention.
Figure 6:
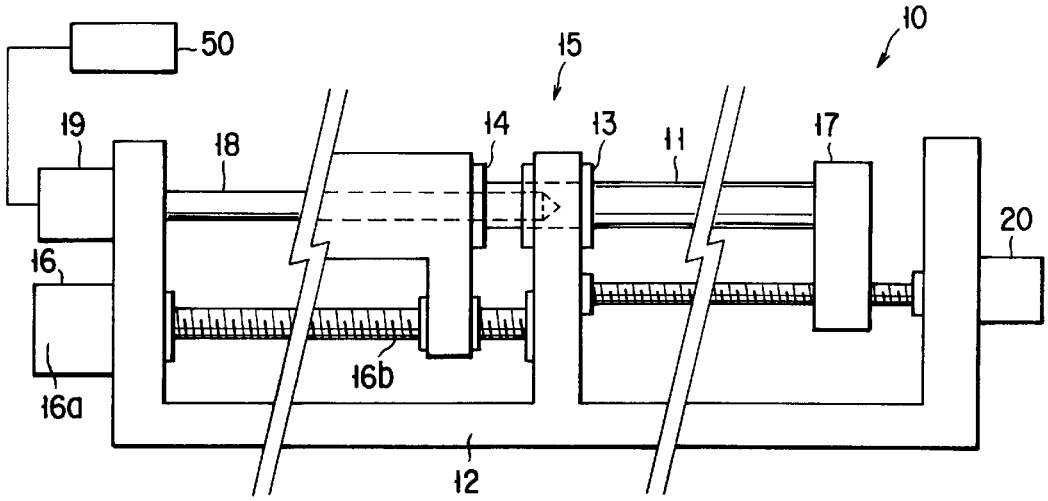
FIG. 6 is a side view schematically showing an outline of the bellows manufacturing apparatus shown in FIG. 5.

The primary forming process S1 is carried out using a bellows manufacturing apparatus 10 shown in FIGS. 5 to 15. FIG. 6 schematically shows the manufacturing apparatus 10. The manufacturing apparatus 10 hydraulically bulges a thin-walled metallic blank tube 11 in the form of a straight pipe as the material of the metallic bellows.

The bellows manufacturing apparatus 10 comprises a base frame 12, a die set 15 including a first die 13 and a second die 14, a die drive mechanism 16 for moving the second die 14 in the axial direction of the tube 11, and a chuck 17 for holding the tube 11. The apparatus 10 further comprises a mandrel 18 inserted in the tube 11, a mandrel drive mechanism 19 for moving the mandrel 18 in the axial direction of the tube 11, a tube feed mechanism 20 for moving the chuck 17 in the axial direction of the tube 11, and the like.

As shown in FIG. 5, the first die 13 is fixed to a first die holder 30. The second die 14 is fixed to a second die holder 31. The second die 14 and the die holder 31 can reciprocate relatively to the first die 13 and the die holder 30 in the axial direction of the tube 11. In this embodiment, the second die holder 31 is moved integrally with the second die 14 in the axial direction of the tube 11 by means of the die drive mechanism 16 (shown in FIG. 6) that includes an actuator such as a servomotor.

The die drive mechanism 16 includes, for example, a servomotor 16*a*, a ball screw 16*b* rotated by means of the servomotor 16*a*, etc. As the servomotor 16*a* rotates in response to input pulses, the second die 14 moves in the axial direction of the tube 11. The die drive mechanism 16 functions also as fine-retreat means according to the present invention.

In this embodiment, the first and second dies 13 and 14 serve as a cavity-side die and a force-side die, respectively, according to the present invention. Alternatively, however, the second die 14 and the die holder 31 may be fixed. In this case, the first die 13 and the die holder 30 are movable in the axial direction of the tube 11.

As shown in FIG. 5 and other drawings, the dies 13 and 14 are formed having holes 34 and 35 in which the tube 11 is inserted. Corresponding to the pleat walls 4 and 5 of the bellows 1 to be formed, forming surfaces 36 and 37 having an S-shaped profile each are formed individually on the respective opposite surfaces of the first and second dies 13 and 14.

Figure 15:
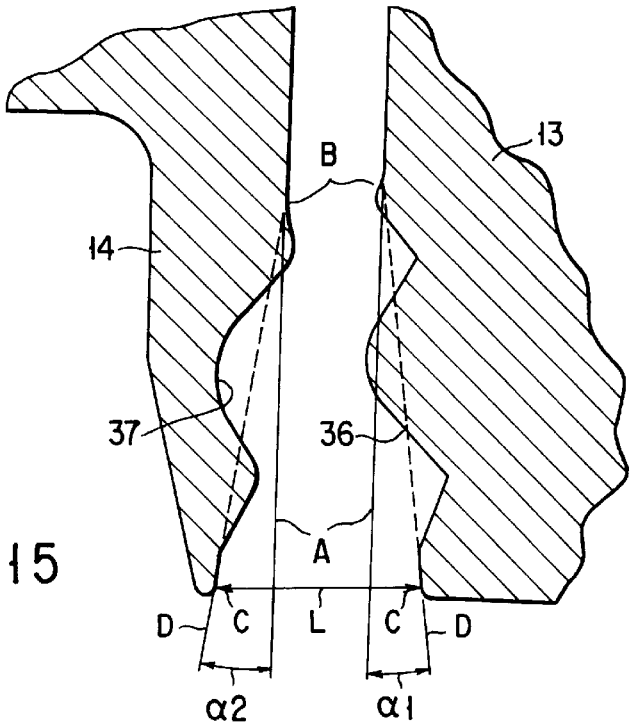
FIG. 15 is an enlarged partial sectional view showing the dies of the bellows manufacturing apparatus shown in FIG. 5.
Figure 16:
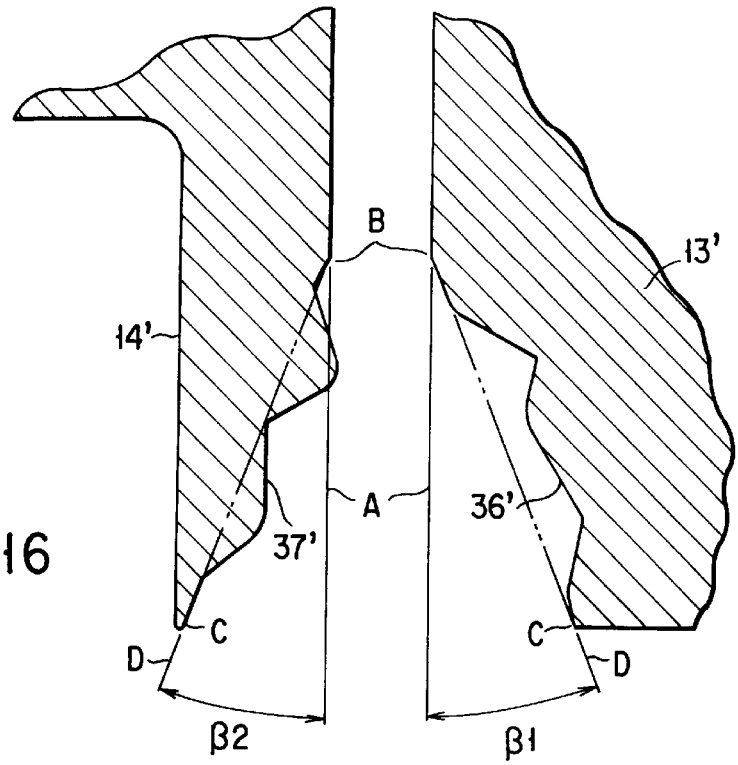
FIG. 16 is an enlarged partial sectional view showing dies according to a comparative example.

As shown in FIG. 15, taper angles $\alpha 1$ and $\alpha 2$ of the respective forming surfaces 36 and 37 of the dies 13 and 14 are narrow angles of 10° or less. For example, $\alpha 1$ and $\alpha 2$ are 6.5° and 8.9°, respectively. FIG. 16 shows dies 13' and 14' as comparative examples, of which taper angles $\beta 1$ and $\beta 2$ of forming surfaces 36', and 37' exceed 20°. For example, $\beta 1$ and $\beta 2$ are 20.6° and 20.4°, respectively. The taper angles $\alpha 1$, $\alpha 2$, $\beta 1$ and $\beta 2$ described herein are angles that are formed individually between segments A that extend at right angles to the respective axes of the dies (or the axis of the tube 11) and segments D that connect proximal portions B and distal end portions C of the forming surfaces.

Figure 7:
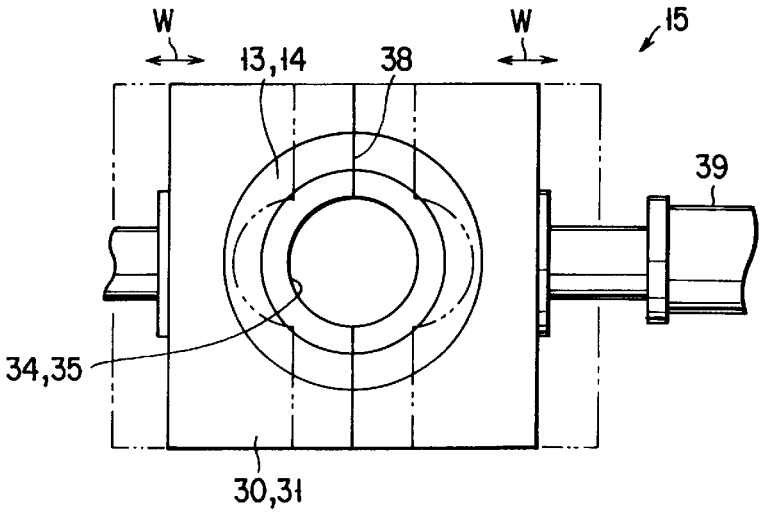
FIG. 7 is a front view showing a part of a die opening/closing mechanism of the bellows manufacturing apparatus shown in FIG. 5.

As shown in the partial view of FIG. 7, the dies 13 and 14 and the die holders 30 and 31 can be halved along a division surface 38 in the diametrical direction (direction indicated by arrow W in FIG. 7) by means of a die opening/closing mechanism 39.

The mandrel 18 is provided with a cylindrical body 40 inserted in the tube 11, a center rod 41, a seal head 42, etc. The center rod 41, which penetrates the body 40, can axially move with respect to the body 40. The seal head 42 is in the form of a piston provided on the distal end portion of the center rod 41. A first seal member 45 that is located on the inner peripheral side of the first die 13 is provided on the outer periphery of the seal head 42.

A second seal member 46 that is located on the inner peripheral side of the second die 14 is provided on the outer periphery of the body 40. Between the seal members 45 and 46, a hydraulic chamber 47 is defined inside the tube 11. The first and second seal members 45 and 46 function as first and second seal means, respectively, according to the present invention.

The center rod 41 is formed having a hydraulic inlet port 48 opening in the hydraulic chamber 47 and a liquid circulating portion 49 that communicates with the port 48. The circulating portion 49 is connected with a hydraulic supplier 50 (shown in FIG. 6) that supplies a pressurized fluid (e.g., water) to the hydraulic chamber 47.

The following is a description of bellows manufacturing processes carried out using the bellows manufacturing apparatus 10.

As shown in FIG. 5, the first and second dies 13 and 14 are isolated from each other. The tube 11 is set in the dies 13 and 14 that are halved (or opened in the diametrical direction). The mandrel 18 is inserted into the tube 11 through its open end.

Figure 8:
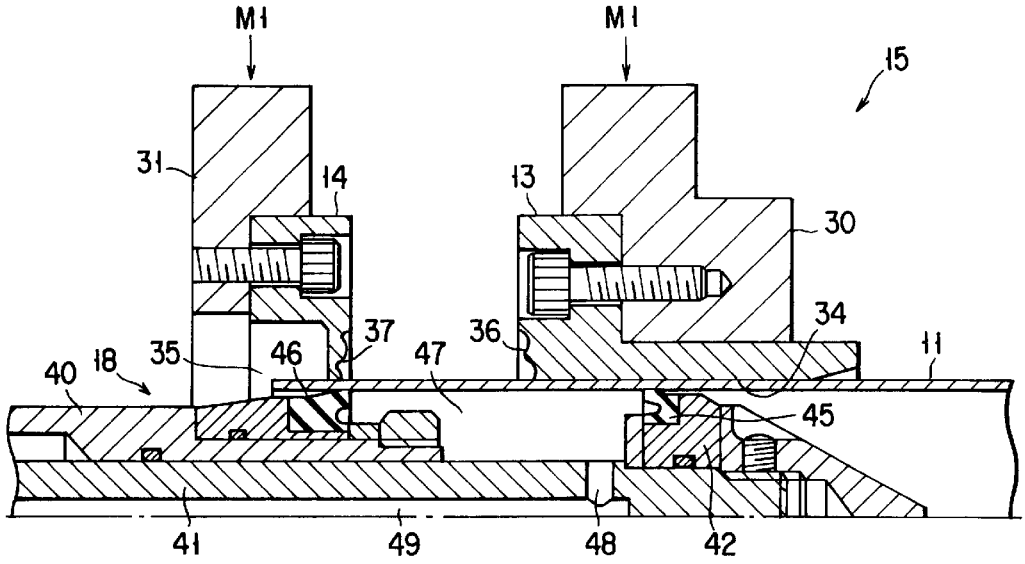
FIG. 8 is a sectional view showing a blank tube set in dies in the bellows manufacturing apparatus shown in FIG. 5.

Thereafter, the dies 13 and 14 are closed in their diametrical direction, as shown in FIG. 8. In FIG. 8, arrow M1 indicates the direction in which the dies 13 and 14 are closed. In this state, the first seal member 45 is located on the inner peripheral side of the first die 13, and the second seal member 46 on the inner peripheral side of the second die 14.

Figure 9:
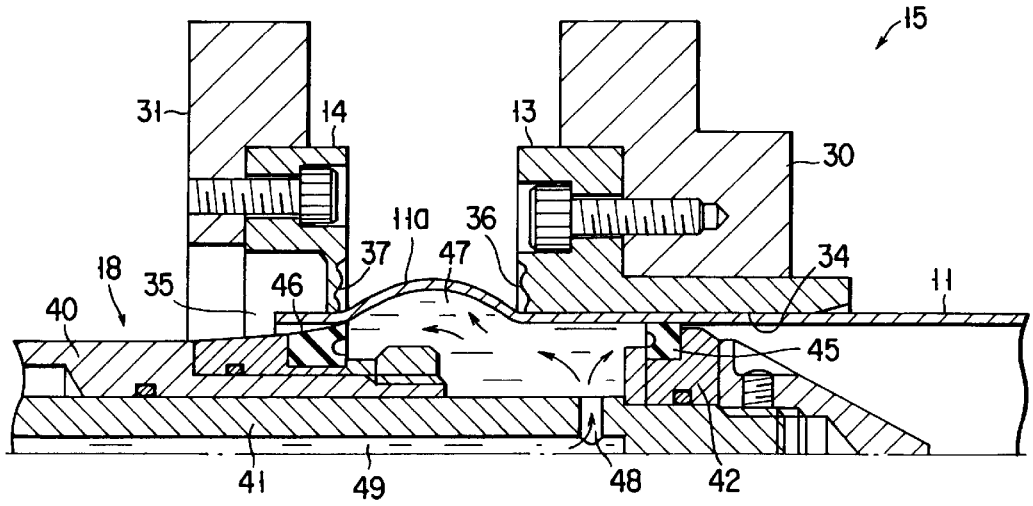
FIG. 9 is a sectional view showing the tube subjected to hydraulic pressure in the bellows manufacturing apparatus shown in FIG. 5.

As shown in FIG. 9, the pressurized fluid (e.g., water) from the hydraulic supplier 50 is fed into the hydraulic chamber 47 through the liquid circulating portion 49 and the hydraulic inlet port 48. The pressure of the liquid supplied to the hydraulic chamber 47 causes a portion 11*a* of the tube 11 slightly to bulge outward in the diametrical direction between the seal members 45 and 46.

Figure 10:
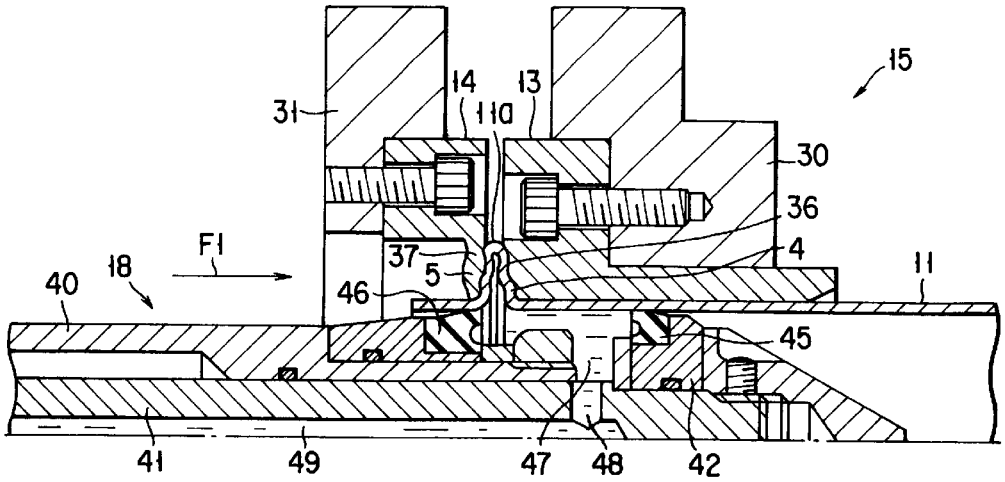
FIG. 10 is a sectional view showing pleat walls formed in the bellows manufacturing apparatus shown in FIG. 5.

With the hydraulic pressure in the hydraulic chamber 47 kept at a certain value, the second die 14 and the second die holder 31, along with body 40 and the seal member 46, are moved in synchronism with each other in the direction of arrow F1 toward the first die 13, as shown in FIG. 10. As this is done, the portion 11*a* of the tube 11 is plastically deformed between the respective forming surfaces 36 and 37 of the dies 13 and 14, whereupon the pleat walls 4 and 5 with the S-shaped profile are formed corresponding to the forming surfaces 36 and 37, respectively.

Figure 11:
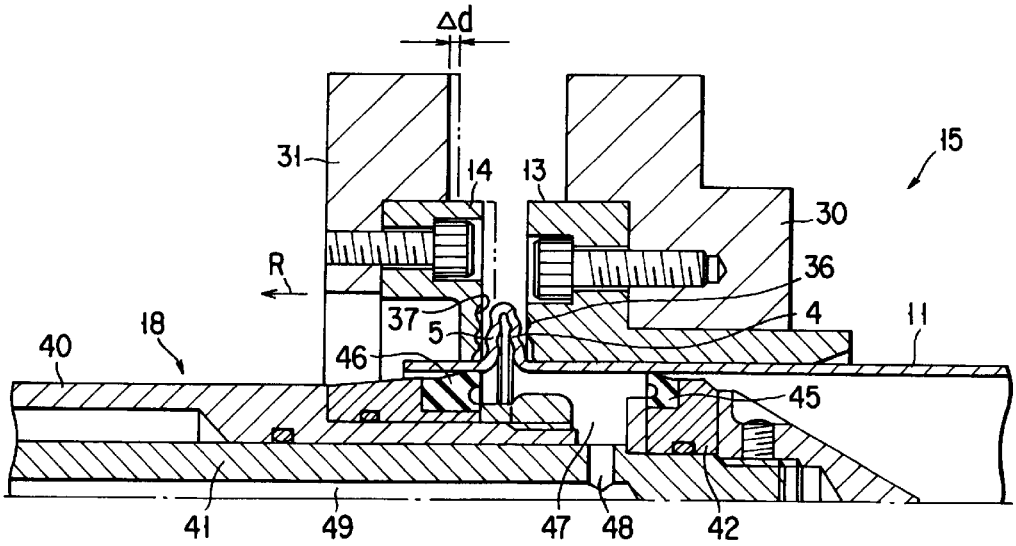
FIG. 11 is a sectional view showing the dies slightly retreated in the bellows manufacturing apparatus shown in FIG. 5.

After the pleat walls 4 and 5 for one pleat are formed in this manner, the second die 14 is returned for a very short distance Δd by means of the die drive mechanism 16 (shown in FIG. 6) in a fine-retreat process shown in FIG. 11. More specifically, the second die 14 is moved away from the first die 13 (in the direction indicated by arrow R) for the short distance Δd. The distance Δd is set corresponding to the pitch (P shown in FIG. 3) of the pleat walls 4 and 5. If the pitch P is 4.4 mm, Δd is about 2 mm. If the pitch P is 2.8 mm, Δd is about 1 mm. If the retreat distance Δd is too long, the second die 14 may possibly scratch the adjacent pleat wall 4. Preferably, the retreat distance Δd should be a short distance not longer than half the pitch P.

Figure 12:
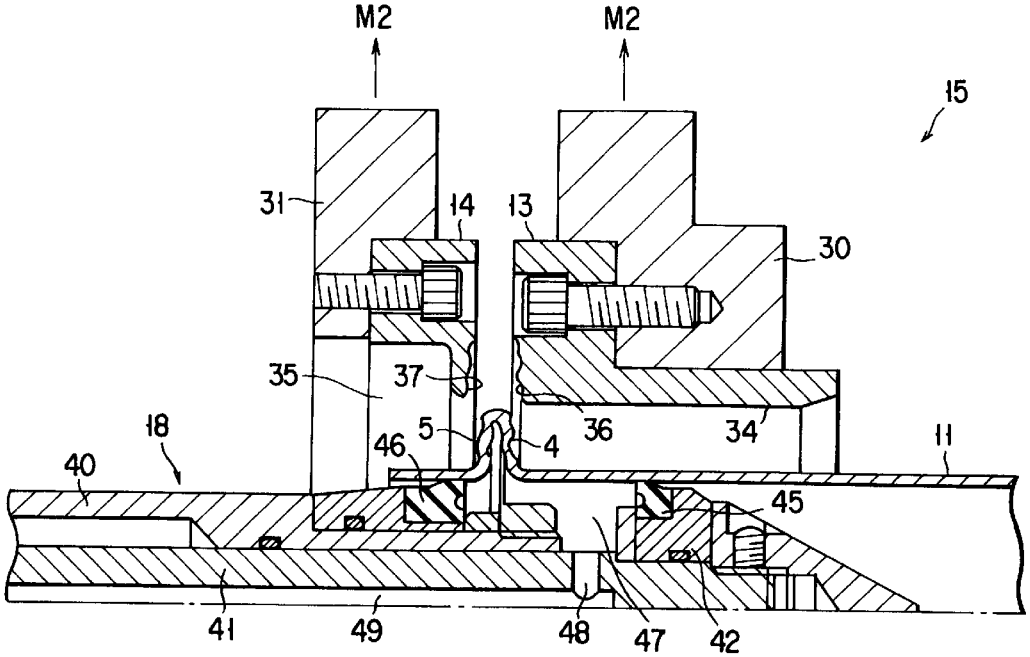
FIG. 12 is a sectional view showing the dies opened in the bellows manufacturing apparatus shown in FIG. 5.

After the second die 14 is slightly retreated in the fine-retreat process, the first and second dies 13 and 14 open in the diametrical direction (direction indicated by arrow M2), as shown in FIG. 12. Since the die 14 is slightly retreated in the fine-retreat process before the dies 13 and 14 open, the respective forming surfaces 36 and 37 of the dies 13 and 14 can avoid heavily touching the pleat walls 4 and 5. Thus, pleat walls 4 and 5 can be prevented from being scratched as the dies 13 and 14 open.

Figure 13:
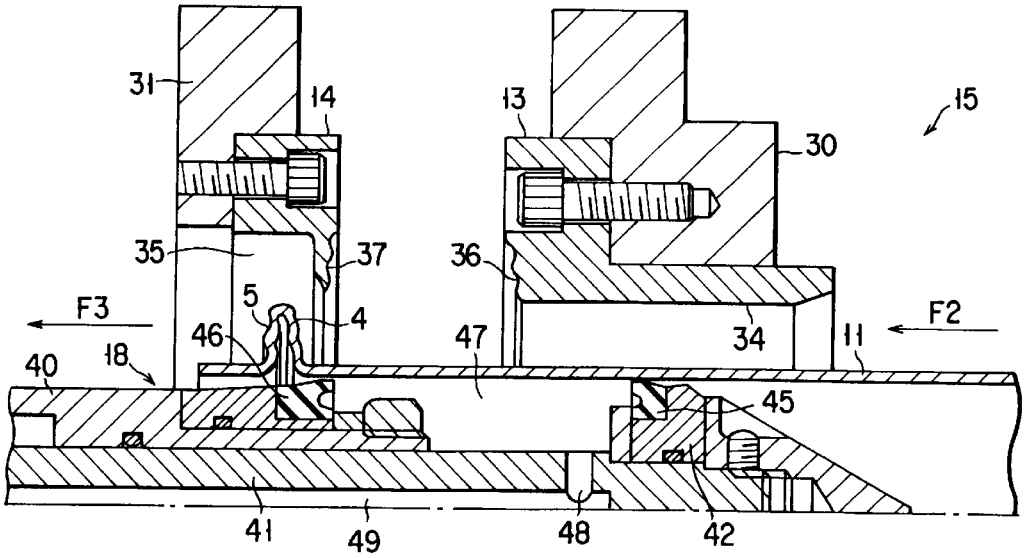
FIG. 13 is a sectional view showing one of the dies moved in the axial direction in the bellows manufacturing apparatus shown in FIG. 5.

After the dies 13 and 14 are opened in the diametrical direction, the tube 11 is fed relatively to the dies 13 and 14 for a given distance in the direction (axial direction) indicated by arrow F2 in FIG. 13 by means of the tube feed mechanism 20. Further, the second die 14 and the second die holder 31 retreat in the direction indicated by arrow F3 and return to the position before the start of forming, and the body 40 and the seal member 46 also retreat synchronously.

Figure 14:
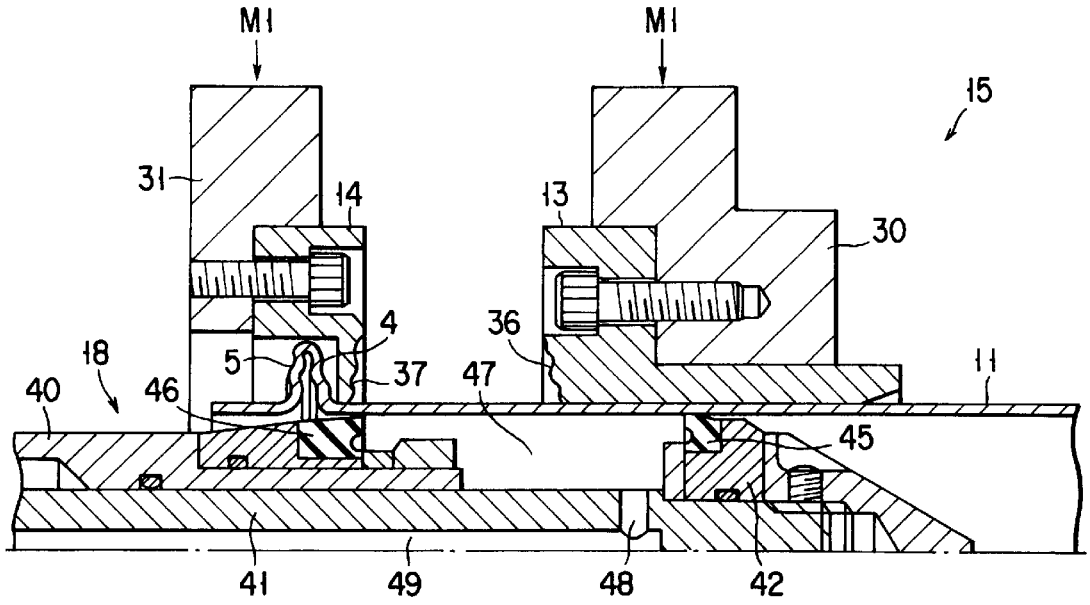
FIG. 14 is a sectional view showing the dies closed in the bellows manufacturing apparatus shown in FIG. 5.

When the forming surface 37 of the second die 14 is situated in front of the pleat wall 4, the first die 13, die holder 30, second die 14, and die holder 31 are closed in the direction of arrow M1, as shown in FIG. 14. The pleat walls 4 and 5 for the next pleat are formed as the aforesaid series of processes shown in FIGS. 9 to 14 is repeated. The formed bellows 1' shown in FIG. 3 is completed by successively forming the pleat walls 4 and 5 for every pleat in this manner.

In the dies 13 and 14 of this embodiment, as shown in FIG. 15, the respective taper angles α1 and α2 of the forming surfaces 36 and 37 are narrow angles of 10° or less. Therefore, a distance L between the respective distal end portions C of the dies 13 and 14 is shorter enough as the pleat walls 4 and 5 are formed. Accordingly, the respective shapes of the forming surfaces 36 and 37 can be easily and accurately copied to the walls 4 and 5 of the tube 11, so that the resulting formed bellows 1' can enjoy a shape similar to that of the bellows 1, a final product, shown in FIG. 4.

Figure 4:
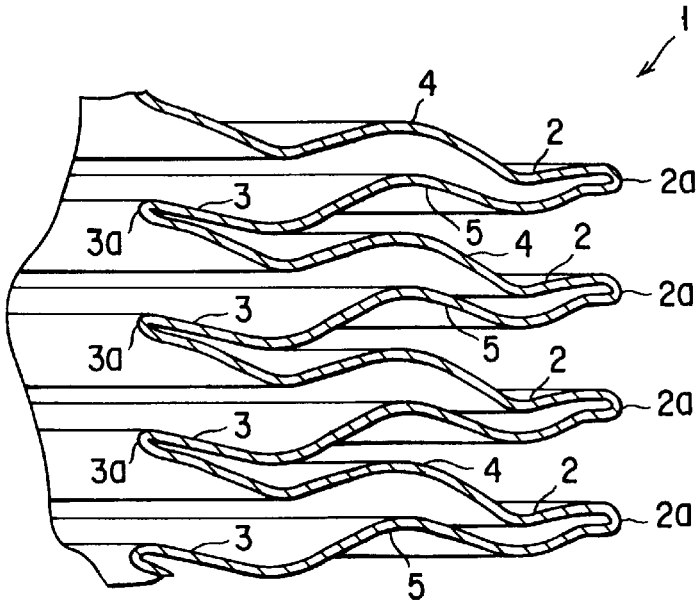
FIG. 4 is an enlarged sectional view showing a part of the bellows shown in FIG. 1.

If the formed bellows 1' is compressed in the axial direction so that the pleat walls 4 and 5 are brought intimately into contact with one another, the respective radii of curvature of a distal end 2*a* of each top portion 2 and a distal end 3*a* of each bottom portion 3 can be further reduced, as shown in FIG. 4.

Figure 17:
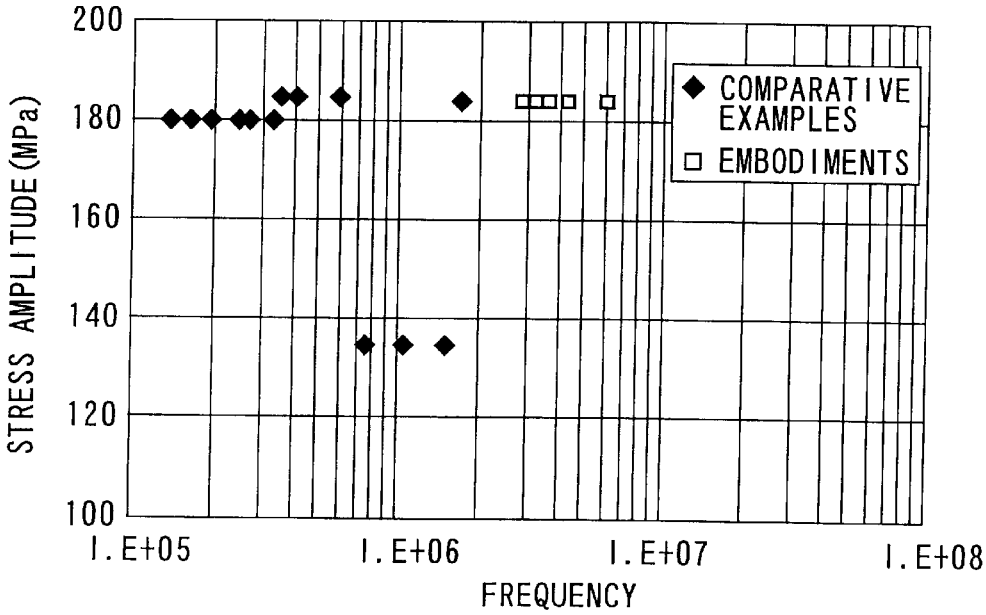
FIG. 17 is a diagram showing results of durability tests on bellows formed by means of dies of two types with different taper angles.

FIG. 16 shows the dies 13' and 14' (comparative examples), of which the respective taper angles β1 and β2 of forming surfaces 36' and 37' exceed 20°. FIG. 17 shows results of durability tests on S-profiled bellows (comparative examples) formed by means of the dies 13' and 14' and S-profiled bellows (embodiments) formed by means of the dies 13 and 14 shown in FIG. 15.

As seen from FIG. 17, the durability of the bellows formed by means of the forming surfaces 36 and 37 with the taper angles α1 and α2 is much higher than that of the bellows formed by means of the forming surfaces 36' and 37' with the taper angles β1 and β2. The reason is that the distance L between the respective distal end portions C of the dies 13 and 14 can be made shorter in the case where the pleat walls 4 and 5 are formed by means of the forming surfaces 36 and 37 than in the case where the forming surfaces 36' and 37' are used, whereby the shapes of the pleat walls 4 and 5 can be stabilized.

In the case where the pleat walls 4 and 5 are formed by means of the forming surfaces 36 and 37, however, the forming surfaces 36 and 37 partially heavily run against the just formed pleat walls 4 and 5, thereby scratching the walls, if the dies 13 and 14 are directly opened in the diametrical direction after the walls 4 and 5 are formed.

Accordingly, the second die 14 of the bellows manufacturing apparatus 10 is slightly retreated in the fine-retreat process, as shown in FIG. 11, just before the dies 13 and 14 are opened in the diametrical direction after the pleat walls 4 and 5 are formed. Thus, the forming surfaces 36 and 37 can be prevented from scratching the pleat walls 4 and 5 as the dies 13 and 14 open in the diametrical direction.

In the foregoing embodiment, the die drive mechanism 16 itself doubles as the fine-retreat means. In carrying out the present invention, however, the fine-retreat means may be a hydraulic or mechanical drive mechanism that is independent of the die drive mechanism 16 and can slightly retreat the second die (force-side die).

Figure 18:
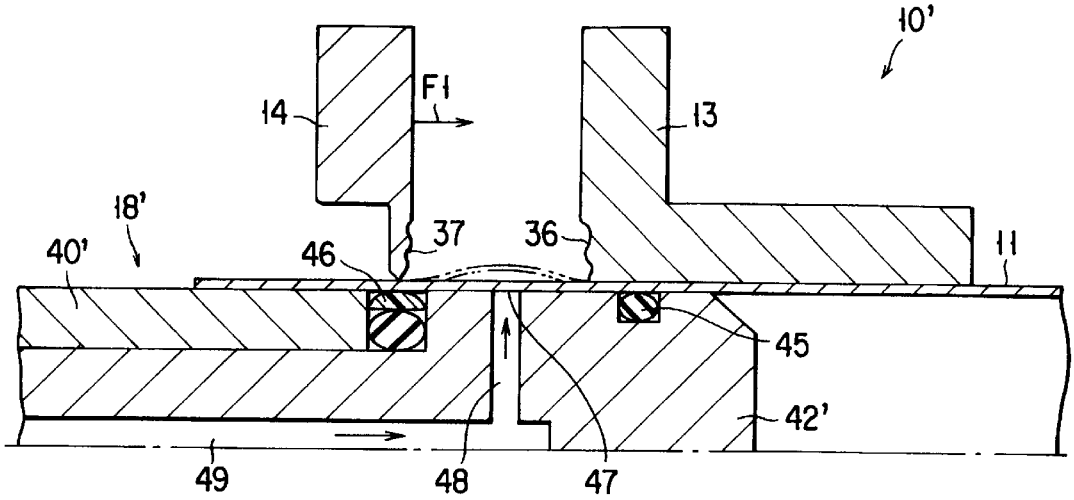
FIG. 18 is a sectional view showing a part of a bellows manufacturing apparatus according to a second embodiment of the invention.
Figure 19:
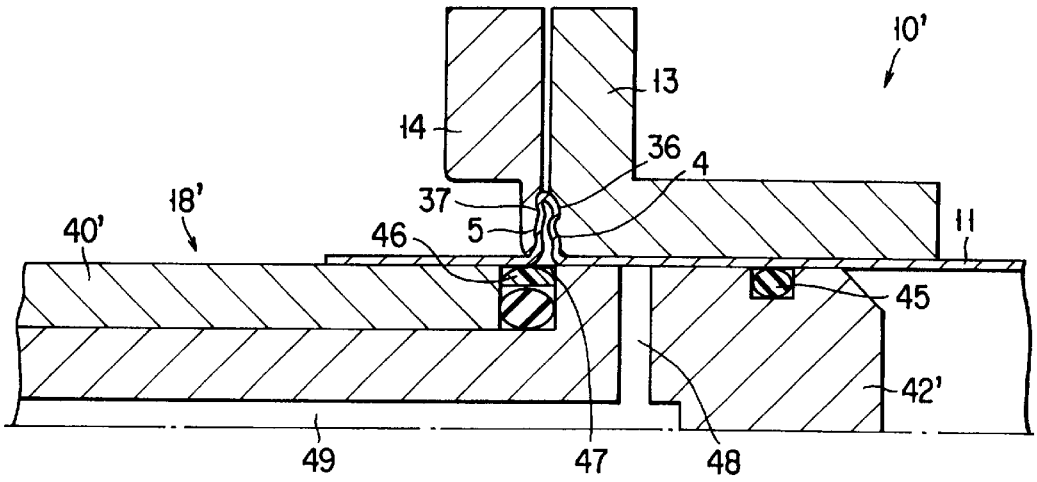
FIG. 19 is a sectional view showing pleat walls formed in the bellows manufacturing apparatus shown in FIG. 18.

FIGS. 18 and 19 show a bellows manufacturing apparatus 10' according to a second embodiment of the present invention. A mandrel 18' of the manufacturing apparatus 10' is composed of a body 40' and a member that integrally includes a seal head 42'. For other configurations and functions, the second embodiment is similar to the first embodiment. When a second die 14 is moved toward a first die 13, in this bellows manufacturing apparatus 10', the seal head 42' and a seal member 45 move in synchronism with the second die 14. As this is done, the seal member 45 moves in the axial direction while sliding on the inner surface of the tube 11. According to this arrangement, the mandrel 18' can enjoy a simple construction.

The following is a description of the pressing process S2 shown in FIG. 2.

Figure 20:
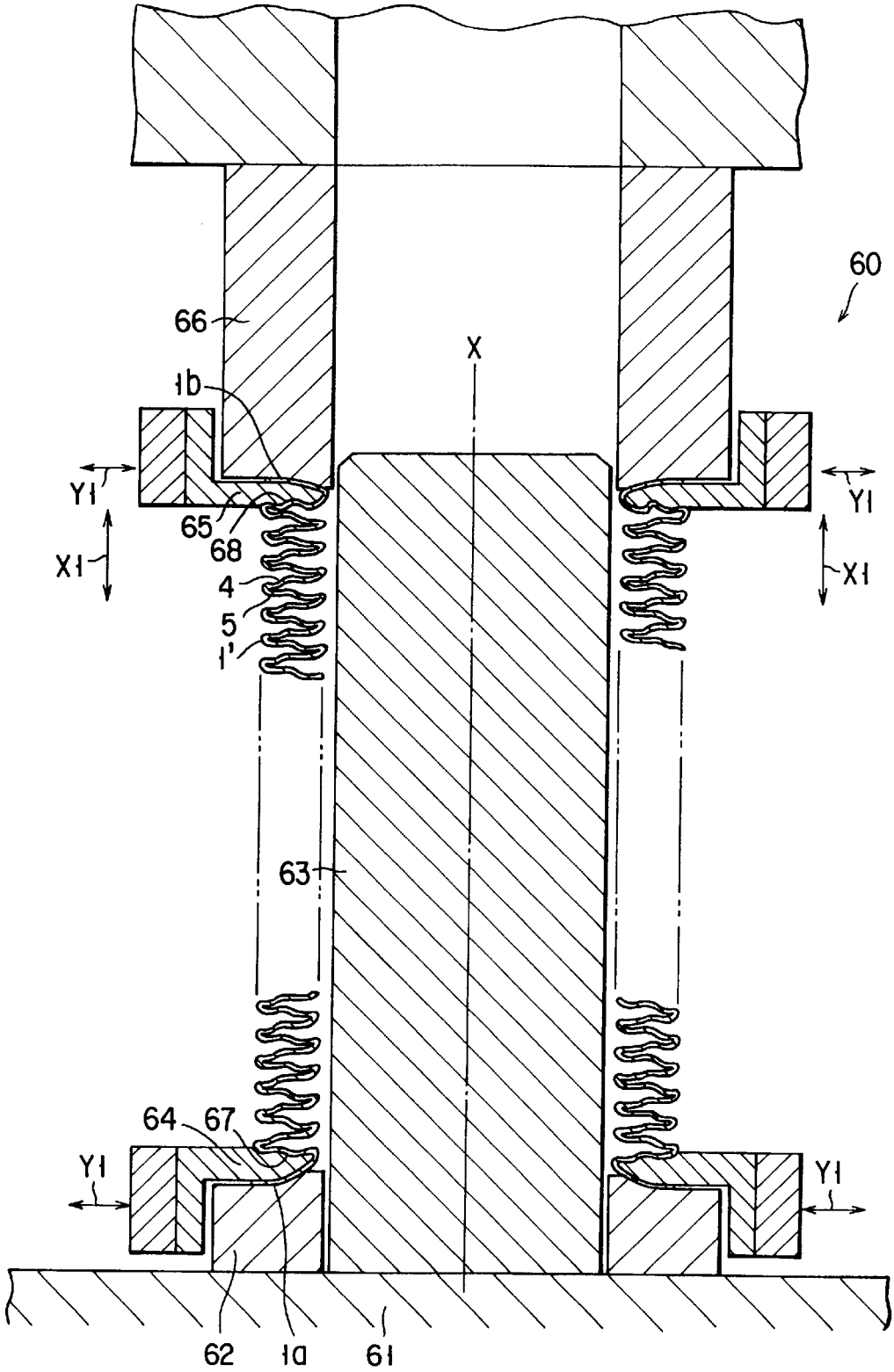
FIG. 20 is a sectional view of an axial drive unit used in a pressing process.

The pressing process S2 is carried out by means of an axial drive unit 60 shown in FIG. 20. The axial drive unit 60 has a function to compress the formed bellows 1' manufactured in the primary forming process S1 in the direction of the axis X. The unit 60 comprises a base member 61, a ring-shaped support seat 62 on the base member 61, a columnar core 63, a ring-shaped bottom force 64 on the support seat 62, a top force 65 opposite to the top of the bottom force 64, a pressure member 66 overlying the top force 65, etc. The pressure member 66 can be moved for a desired distance in the direction of the axis X of the formed bellows 1' (direction indicated by arrow X1 in FIG. 20) by means of an actuator (not shown).

The bottom and top forces 64 and 65 can be opened and closed in the diametrical direction of the bellows 1' (direction indicated by arrow Y1 in FIG. 20) by means of actuators (not shown), individually.

The core 63, which are coaxial with the forces 64 and 65, has a centering function to align the respective centers of the dies 64 and 65 and the formed bellows 1'. Besides, the core 63 serves to prevent the formed bellows 1' from falling or bending outward as the bellows 1' is compressed in the axial direction.

Figure 21:
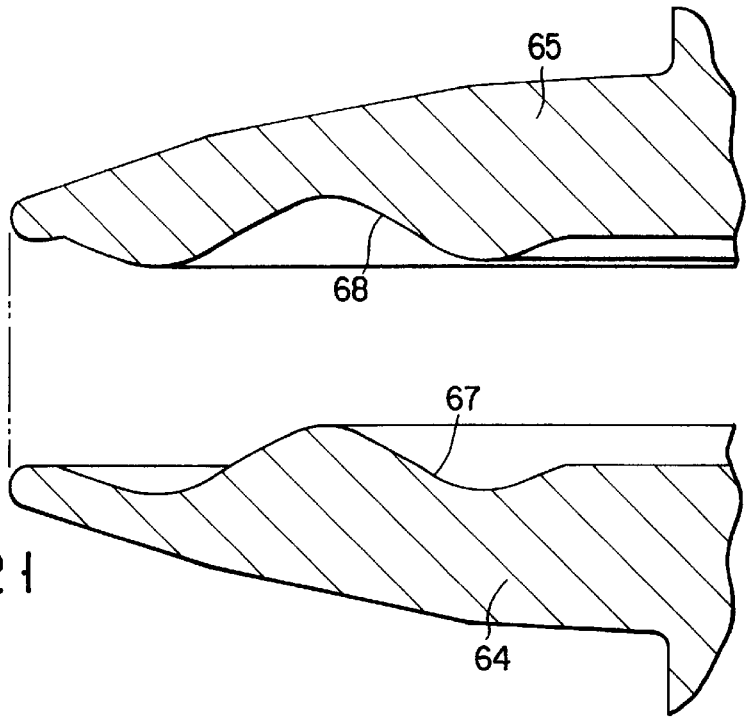
FIG. 21 is an enlarged partial sectional view showing top and bottom forces of the axial drive unit shown in FIG. 20.

As shown in FIG. 21, bearing surfaces 67 and 68 are formed on the respective opposite surfaces of the bottom and top forces 64 and 65, respectively. The one bearing surface 68 has a shape corresponding to one pleat wall 4. The other bearing surface 67 has a shape corresponding to the other pleat wall 5. The formed bellows 1' to be set in the axial drive unit 60 is oriented so that the pleat walls 4 and 5 face the bearing surfaces 68 and 67, respectively.

As shown in FIG. 20, one end portion 1*a* of the formed bellows 1' is interposed between the support seat 62 and the bottom force 64. The other end portion 1*b* is interposed between the top force 65 and the pressure member 66. The end portion 1*a* is held by means of the support seat 62 and the bottom force 64, and the other end portion 1*b* by means of the top force 65 and the pressure member 66. The bottom and top forces 64 and 65 can be halved in the diametrical direction so that they can be released from the opposite end portions 1*a* and 1*b* of the bellows 1'.

The pressure member 66 presses the top force 65 toward the bottom force 64. AS this is done, the formed bellows 1' is compressed in the direction of the axis X by means of the forces 64 and 65 so that the pleat walls 4 and 5 come intimately into contact with one another. By carrying out the pressing process S2, the respective radii of curvature of the distal end 2*a* of each top portion 2 and the distal end 3*a* of each bottom portion 3 can be reduced, as shown in FIG. 4, so that the bellows 1 of a desired product shape can be obtained. Since the radius of curvature of the distal end 3*a* of each bottom portion 3 can be made smaller enough than that of the formed bellows 1' (shown in FIG. 3), in particular, the short compact-state length, a feature of an S-shaped bellows, can be utilized efficiently.

The bellows 1 having undergone the pressing process S2 is substantially a rigid body without springiness because its pleat walls 4 and 5 are located very close to one another. In order to give the bellows 1 the function of a spring, therefore, the stretching process S3 is carried out. The axial drive unit 60 shown in FIG. 20 is also used for the stretching process S3. By pulling the bellows 1 in the direction of the axis X by means of the axial drive unit 60, the length of the bellows 1 can be freely adjusted to ensure given pitches.

In this embodiment, the opposite end portions 1*a* and 1*b* of the bellows 1 are held by means of the bottom and top forces 64 and 65, respectively. With use of the axial drive unit 60, the stretching process S3 can be carried out without interruption after the pressing process S2, and in the stretching process S3, the bellows 1 can be stretched by a desired length in the direction of the axis X. Thus, a series of processes including the pressing process S2 and the stretching process S3 can be continuously carried out with high efficiency.

In pulling the bellows 1 in the direction of the axis X in the stretching process S3, the whole bellows 1 may be pulled at a time to obtain a desired free length. Alternatively, the bellows 1 may be divided into a plurality of regions in the direction of the axis X so that the individual regions can be pulled separately. Alternatively, moreover, the whole bellows 1 may be pulled after individual regions of the bellows in the direction of the axis X are pulled separately.

The annealing and ageing heat-treatment process S4 is carried out after the stretching process S3. The heat-treatment process S4 is carried out in order to ease residual stress that is generated in the bellows 1 in the primary forming process S1, pressing process S2, stretching process S3, etc. In the heat-treatment process S4, annealing and ageing (removal of distortion) are carried out in a manner such that the bellows 1 is kept within the following temperature region for a given time. In the heat-treatment process S4, the residual stress of the bellows 1 is eased, and besides, the area of elasticity of the bellows 1 as a spring extends, so that the durability of the bellows 1 regarding to the repeated amplitude is improved.

Figure 22:
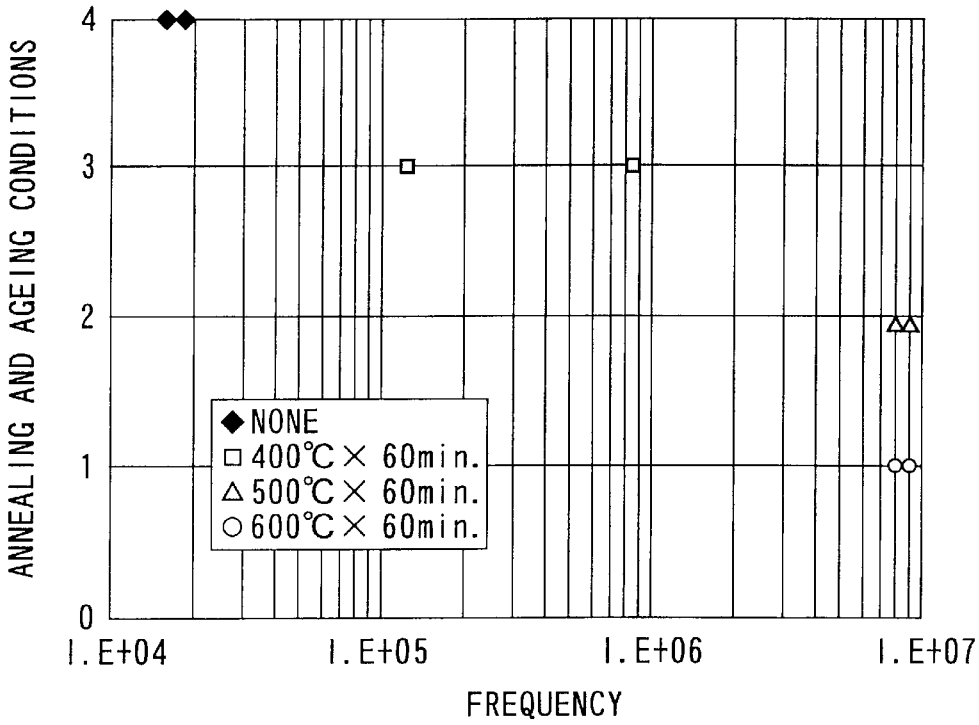
FIG. 22 is a diagram showing the relation between annealing and ageing conditions and endured frequency.
Figure 23:
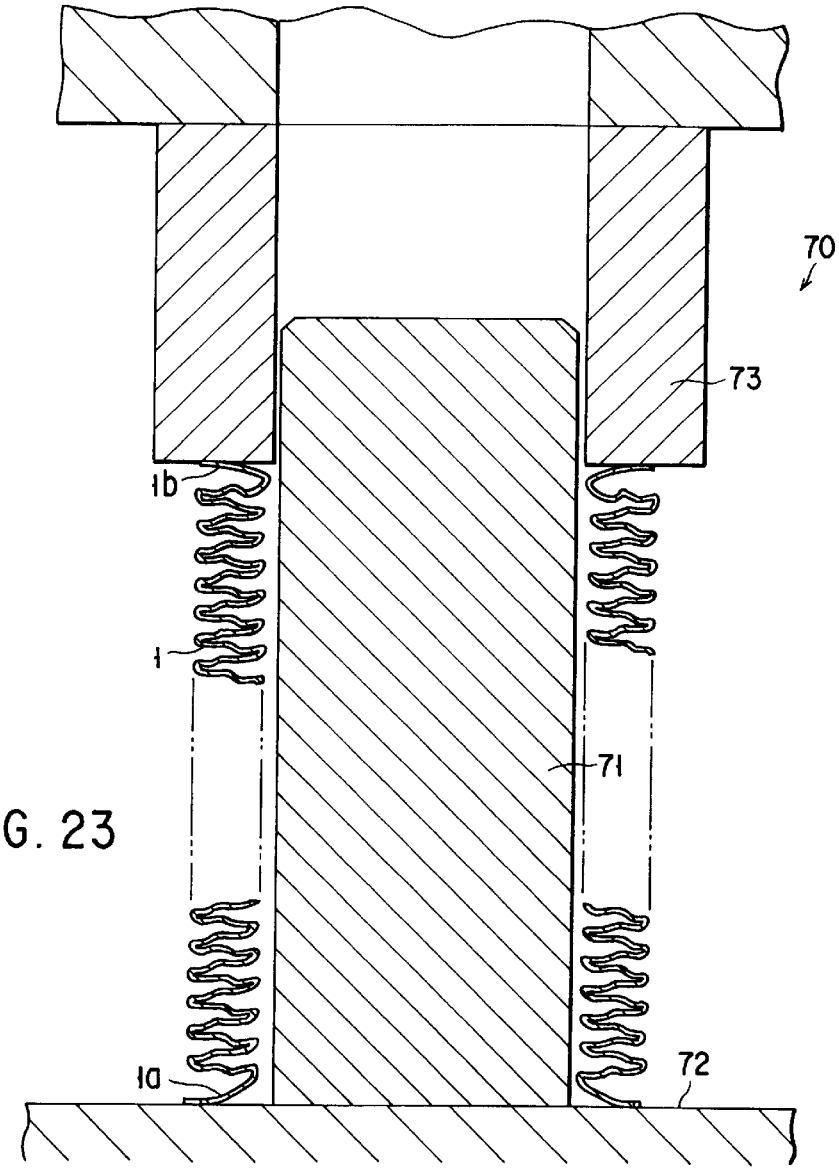
FIG. 23 is a sectional view of a compressing unit used in a setting process.

The inventors hereof conducted durability tests for examining the durability of the bellows 1 of stainless steel for the case where the bellows 1 was subjected to the heat-treatment process S4. FIG. 22 shows results of the tests. When the annealing and ageing temperature was 400° C., the durability was not improved much. However, the durability of the bellows was higher than in the case where annealing and ageing were not carried out. The durability of the bellows was considerably improved in the annealing and ageing temperature range higher than 400° C. and not lower than 600° C. It is to be desired, therefore, that the bellows 1 should be subjected to the heat-treatment process S4 at 400° C. to 600° C. for about 60 minutes, and it is advisable, in particular, to carry out annealing and ageing at a temperature higher than 400° C.

After undergoing the heat-treatment process S4, the bellows 1 is subjected to the setting process S5 by means of a compressing unit 70. The compressing unit 70 comprises a base member 72 including a core 71, a cylindrical compressing member 73 movable in the axial direction of the core 71, an actuator (not shown) for moving the compressing member 73 for a given distance in the axial direction of the bellows 1, and the like.

In the compressing unit 70, the compressing member 73 applies an axial compressive load to the bellows 1, thereby compressing the bellows more deeply than during use. In this setting process S5, the permanent set of the metallic bellows 1 can be improved. The setting process S5 may alternatively be carried out by means of the axial drive unit 60 (FIG. 20) that is used in the pressing process S2 and the stretching process S3.

In the formed bellows 1' that is compressed in the pressing process S2, the pleat walls 4 and 5 are formed into S-shaped configurations in advance in the primary forming process S1. In the pressing process S2, therefore, it is necessary only that the bellows 1 be able to be compressed in the direction so that the respective radii of curvature of the distal end 2*a* of each top portion and the distal end 3*a* of each bottom portion are shorter than those of the formed bellows 1'.

Figure 24:
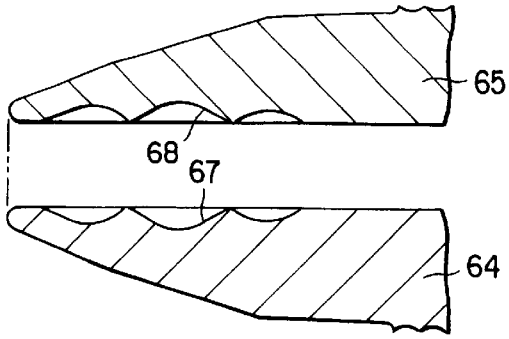
FIG. 24 is a partial sectional view showing top and bottom forces of an axial drive unit according to a third embodiment of the invention.

As shown in FIG. 24, therefore, bottom and top forces 64 and 65 with bearing surfaces 67 and 68 in a common shape may be used in the pressing process S2. The bottom and top forces 64 and 65 having the common-shaped bearing surfaces 67 and 68 can be oriented without regard to the direction of the formed bellows 1'. Thus, the formed bellows 1' can be easily set in the axial drive unit 60, and there is no possibility of the bellows 1' being set in a wrong direction.

Figure 25:
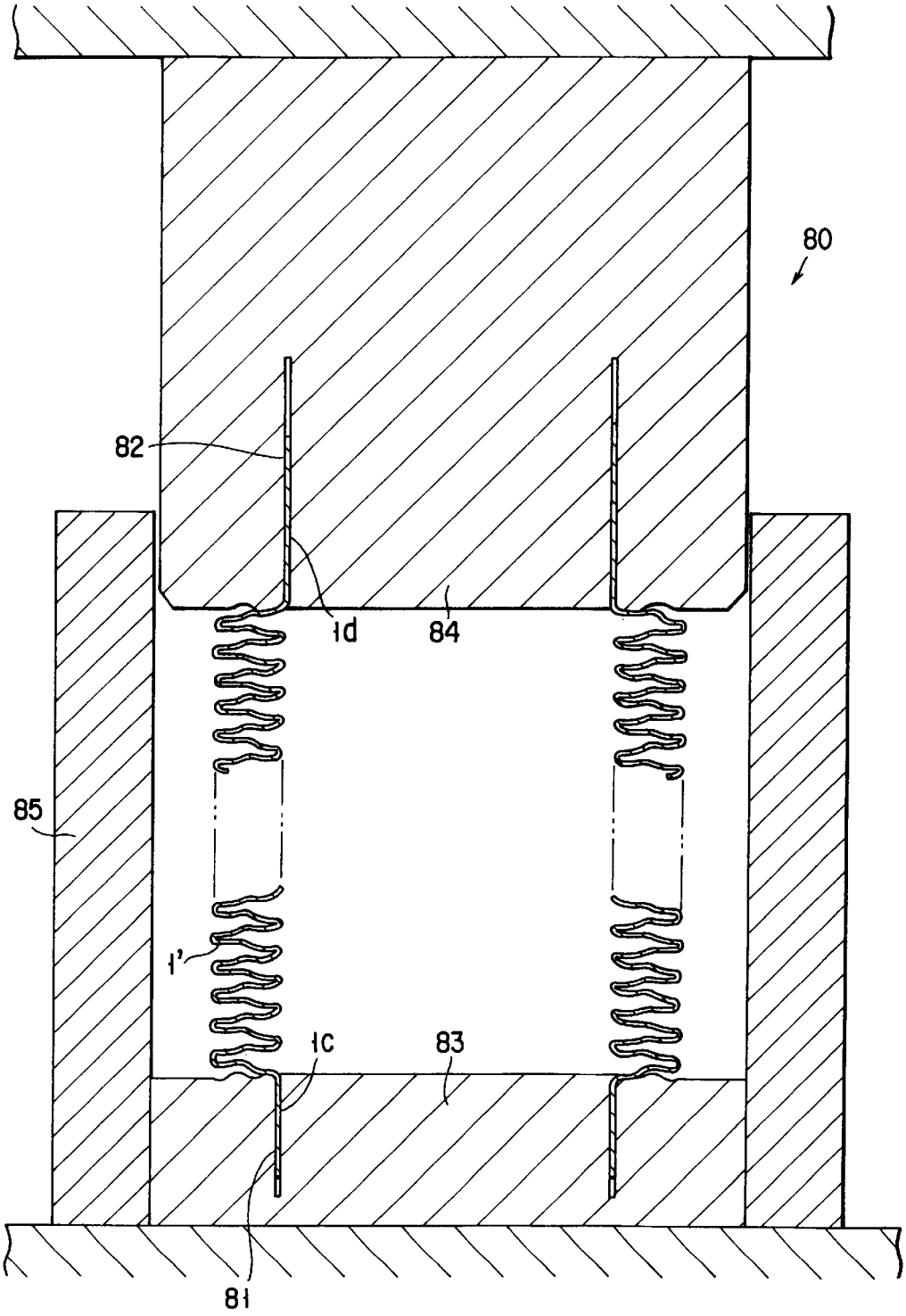
FIG. 25 is a sectional view of an axial drive unit according to a fourth embodiment of the invention.

A formed bellows 1' shown in FIG. 25 has opposite end portions 1*c* and 1*d* in the form of a straight pipe each. In this case, bottom and top forces 83 and 84 having annular slits 81 and 82 into which the end portions 1*c* and 1*d* can be inserted, respectively, should be used in the pressing process S2 and the setting process S5. With use of an axial drive unit 80 including these forces 83 and 84, the formed bellows 1' having the straight end portions 1*c* and 1*d* can be compressed in the axial direction along a guide member 85.

Figure 26:
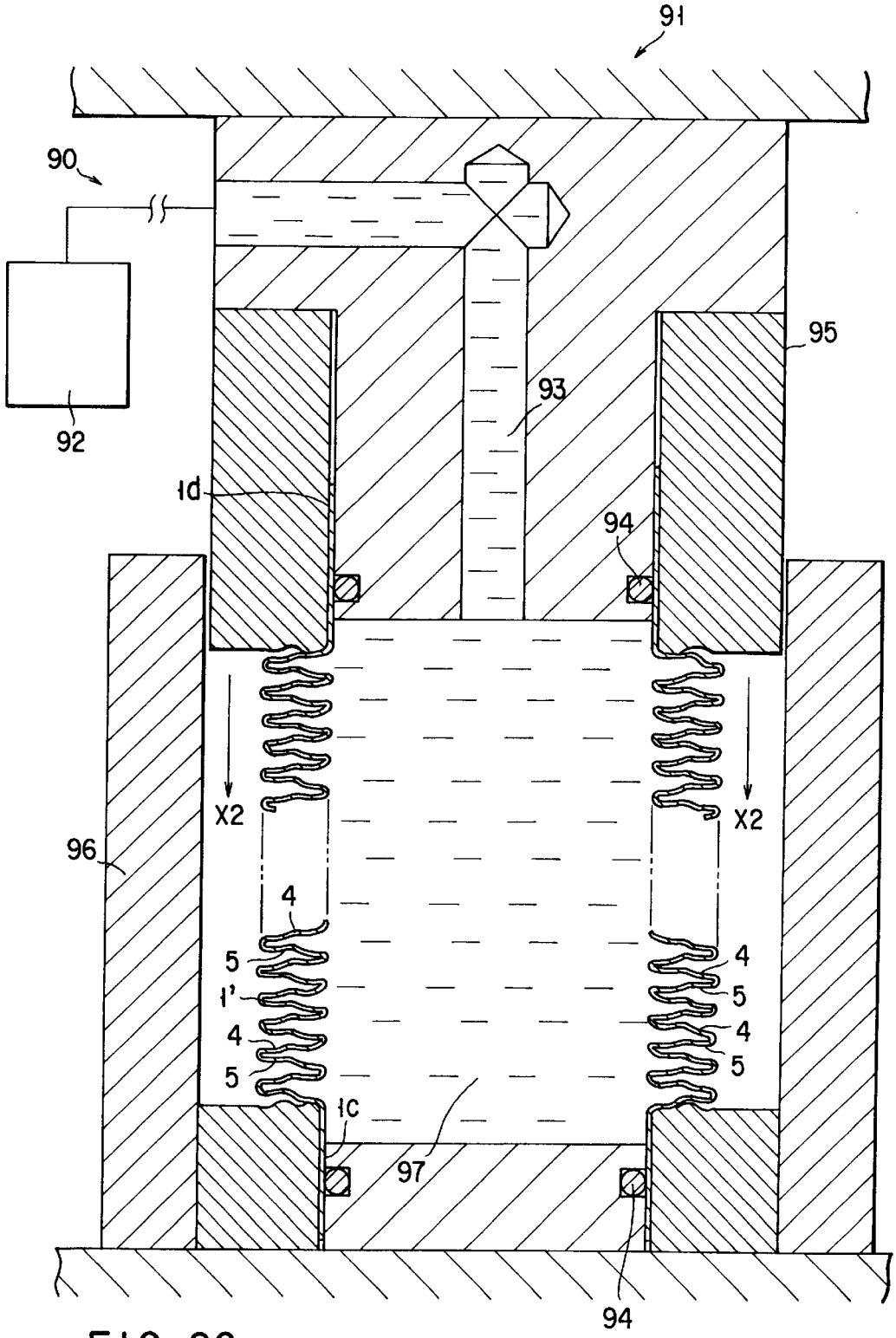
FIG. 26 is a sectional view of an axial drive unit according to a fifth embodiment of the invention.

Alternatively, an axial drive unit 91 including a hydraulic pressure applying mechanism 90 shown in FIG. 26 may be used in the pressing process S2. The unit 91 comprises a hydraulic source 92, a liquid channel 93 opening into the internal space of a bellows 1', a seal member 94 for hermetically sealing the internal space of the bellows 1', a pressure member 95, a cylindrical guide member 96, etc. The hydraulic source 92 feeds a pressurized liquid (e.g., water or oil) into the formed bellows 1'.

With the formed bellows 1' compressed in the axial direction (direction indicated by arrow X2 in FIG. 26) by means of the pressure member 95, a liquid 97 compressed by means of the hydraulic source 92 is introduced into the bellows 1'. The radius of curvature of the distal end 3*a* (shown in FIG. 4) of each bottom portion can be reduced by causing the pressure of the liquid 97 to act on pleat walls 4 and 5.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A manufacturing method for a metallic bellows, comprising:

a primary forming process for forming top and bottom portions comprising pleat walls with S-shaped profiles on a metallic blank tube so as to be arranged alternately in the axial direction of the tube to thereby form the metallic bellows;

a pressing process for compressing the formed metallic bellows in the axial direction, said pressing process includes applying an axial load to the formed metallic bellows and applying hydraulic pressure to the metallic bellows from inside thereby reducing the radius of curvature of a distal end of each bottom portion of the metallic bellows; and a stretching process for pulling the metallic bellows in the axial direction after the pressing process to thereby obtain desired pitches and free length.

2. A manufacturing method for a metallic bellows according to claim 1, wherein said stretching process is followed by an annealing and ageing heat treatment process.

3. A manufacturing method for a metallic bellows according to claim 2, wherein said heat-treatment process is followed by a setting process for compressing the bellows in the axial direction to obtain desired pitches and free length.

4. A manufacturing apparatus for a metallic bellows formed from a metallic blank tube, comprising:

a first die provided around the metallic blank tube;

a second die located at a distance from the first die in the axial direction of the tube and dividable in a diametrical direction of the tube, respective opposite surfaces of said first die and said second die are provided individually with forming surfaces for forming the pleat walls with S-shaped profiles, respective taper angles of the forming surfaces of said first die and said second die, with respect to segments perpendicular to an axis of the tube, are narrow angles of 10° or less, first seal means provided on an inner surface of the tube so as to be located corresponding to the first die;

second seal means provided in the inner surface of the tube so as to be located corresponding to the second die and defining a hydraulic chamber in conjunction with the first seal means;

hydraulic supply means for supplying a pressurized liquid to the hydraulic chamber, thereby causing a part of the tube to expand outward;

a die drive mechanism for moving the second die toward the first die, thereby plastically deforming the expanded part of the tube to form pleat walls between the first die and the second die;

fine-retreat means for slightly retreating the second die away from the pleat walls before the second die is opened in the diametrical direction of the tube after the pleat walls are formed;

a die opening/closing mechanism for opening the second die in the diametrical direction after the second die is retreated by means of the fine-retreat means; and a tube feed mechanism for relatively moving the tube for a given distance in the axial direction of the tube with respect to the second die and the first die after the second die is opened in the diametrical direction.

* * * * *